US009841157B2

(12) United States Patent
Nagao et al.

(10) Patent No.: US 9,841,157 B2
(45) Date of Patent: Dec. 12, 2017

(54) LAMP AND VEHICLE HEADLAMP

(71) Applicant: Panasonic Intellectual Property Management Co., Ltd., Osaka (JP)

(72) Inventors: Nobuaki Nagao, Gifu (JP); Seigo Shiraishi, Osaka (JP); Yoshihisa Nagasaki, Osaka (JP); Takashi Ohbayashi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 219 days.

(21) Appl. No.: 14/726,634

(22) Filed: Jun. 1, 2015

(65) Prior Publication Data

US 2015/0354761 A1 Dec. 10, 2015

(30) Foreign Application Priority Data

Jun. 6, 2014 (JP) ..... 2014-117219

(51) Int. Cl.
*F21S 8/10* (2006.01)
*F21V 9/16* (2006.01)
(Continued)

(52) U.S. Cl.
CPC ..... *F21S 48/1225* (2013.01); *F21S 48/1104* (2013.01); *F21S 48/115* (2013.01);
(Continued)

(58) Field of Classification Search
CPC .. F21S 48/1104; F21S 48/115; F21S 48/1154; F21S 48/13; F21S 48/1323;
(Continued)

(56) References Cited

U.S. PATENT DOCUMENTS 7,695,164 B2 * 4/2010 Berben ..... F21S 48/1394 362/307
2005/0105301 A1 * 5/2005 Takeda ..... F21S 48/1154 362/545

(Continued)

FOREIGN PATENT DOCUMENTS

JP 2011-221502 11/2011
JP 2012-109201 6/2012

OTHER PUBLICATIONS

English Machine Translation of JP 2011221502 from ESPACENET.*

*Primary Examiner* — Jong-Suk (James) Lee
*Assistant Examiner* — Zheng Song
(74) *Attorney, Agent, or Firm* — McDermott Will & Emery LLP

(57) ABSTRACT

A lamp includes: first and second semiconductor light-emitting elements adapted to emit excitation light; a wavelength conversion element adapted to convert the excitation light into light having a peak wavelength different from that of the excitation light; and a concave mirror adapted to reflect the excitation light emitted from the semiconductor light-emitting elements to the wavelength conversion element and reflect the light from the wavelength conversion element toward an outside of the lamp. A distance y1 from an optical axis of the first semiconductor light-emitting element to an optical axis of the concave mirror satisfies $(D+Dphos)/2 \leq y1 \leq 4f$, and a distance y2 from an optical axis of the second semiconductor light-emitting element to the optical axis of the concave mirror satisfies $4f < y2 \leq R$.

16 Claims, 14 Drawing Sheets

(51) Int. Cl.
*F21Y 115/30* (2016.01)
*F21Y 115/10* (2016.01)

(52) U.S. Cl.
CPC ..... *F21S 48/1388* (2013.01); *F21S 48/1145* (2013.01); *F21S 48/13* (2013.01); *F21S 48/1317* (2013.01); *F21S 48/1323* (2013.01); *F21V 9/16* (2013.01); *F21Y 2115/10* (2016.08); *F21Y 2115/30* (2016.08)

(58) Field of Classification Search
CPC ..... F21S 48/1341; F21S 48/1388; F21S 48/1317; F21V 14/02; F21V 9/16
See application file for complete search history.

(56) References Cited

U.S. PATENT DOCUMENTS

2012/0195057 A1* 8/2012 Kishimoto ..... F21S 48/1159 362/516
2013/0003400 A1* 1/2013 Kijima ..... F21S 48/1159 362/517
2013/0201708 A1* 8/2013 Takahashi ..... B60Q 1/0047 362/510
2013/0235601 A1* 9/2013 Takahashi ..... F21V 7/06 362/465
2014/0063779 A1* 3/2014 Bradford ..... F21K 9/1375 362/84
2014/0204398 A1* 7/2014 Sato ..... B60Q 1/0023 356/614
2014/0340918 A1* 11/2014 Suckling ..... F21V 9/16 362/510
2015/0167905 A1* 6/2015 Khrushchev ..... F21K 9/56 362/84

* cited by examiner

LAMP AND VEHICLE HEADLAMP

BACKGROUND

1. Technical Field

The present disclosure relates to a lamp including a wavelength conversion element that is excited by excitation light from a semiconductor light-emitting element.

2. Description of the Related Art

A conventionally known lamp includes a semiconductor laser that emits laser light, a reflector that reflects the laser light emitted from the semiconductor laser, and a light emitting portion that emits light when irradiated with the reflected laser light (Japanese Unexamined Patent Application Publication No. 2012-109201). A conventionally known light source apparatus for a projector includes an excitation laser light source as a solid state light source, a phosphor that emits visible light when excited by the laser light including ultraviolet light emitted from the excitation laser light source, a reflector that reflects the light emitted from the phosphor in a predetermined direction, and a phosphor attachment member that positions the phosphor at a focal position of the reflector (Japanese Unexamined Patent Application Publication No. 2011-221502). The phosphor attachment member includes a reflection mirror that efficiently guides light emitted from the phosphor to a reflection surface of a reflector.

SUMMARY

One non-limiting and exemplary embodiment provides a lamp that properly emits light even when a light source thereof, which emits excitation light, is vibrated.

In one general aspect, the techniques disclosed here feature a lamp including: a plurality of semiconductor light-emitting elements adapted to emit excitation light; a wavelength conversion element adapted to convert the excitation light into light having a peak wavelength different from that of the excitation light; and a concave mirror adapted to reflect the excitation light emitted from the plurality of semiconductor light-emitting elements to the wavelength conversion element and reflect the light from the wavelength conversion element to outside of the lamp. The plurality of semiconductor light-emitting elements includes a first semiconductor light-emitting element and a second semiconductor light-emitting element. A distance y1 from an optical axis of the first semiconductor light-emitting element to an optical axis of the concave mirror satisfies $(D+Dphos)/2 \leq y1 \leq 4f$. A distance y2 from an optical axis of the second semiconductor light-emitting element to the optical axis of the concave mirror satisfies $4f < y2 \leq R$. D is a beam diameter of the excitation light, Dphos is a length of the wavelength conversion element in a direction perpendicular to the optical axis of the concave mirror, f is a focal distance of the concave mirror, and R is a radius of an opening of the concave mirror.

In the embodiments of the present disclosure, light can be properly emitted even when the excitation light source is vibrated. Thus, the lamp has higher optical reliability.

It should be noted that general or specific aspects of the present disclosure may be implemented as a lamp, a vehicle headlamp, an apparatus, a system, a method, or any combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
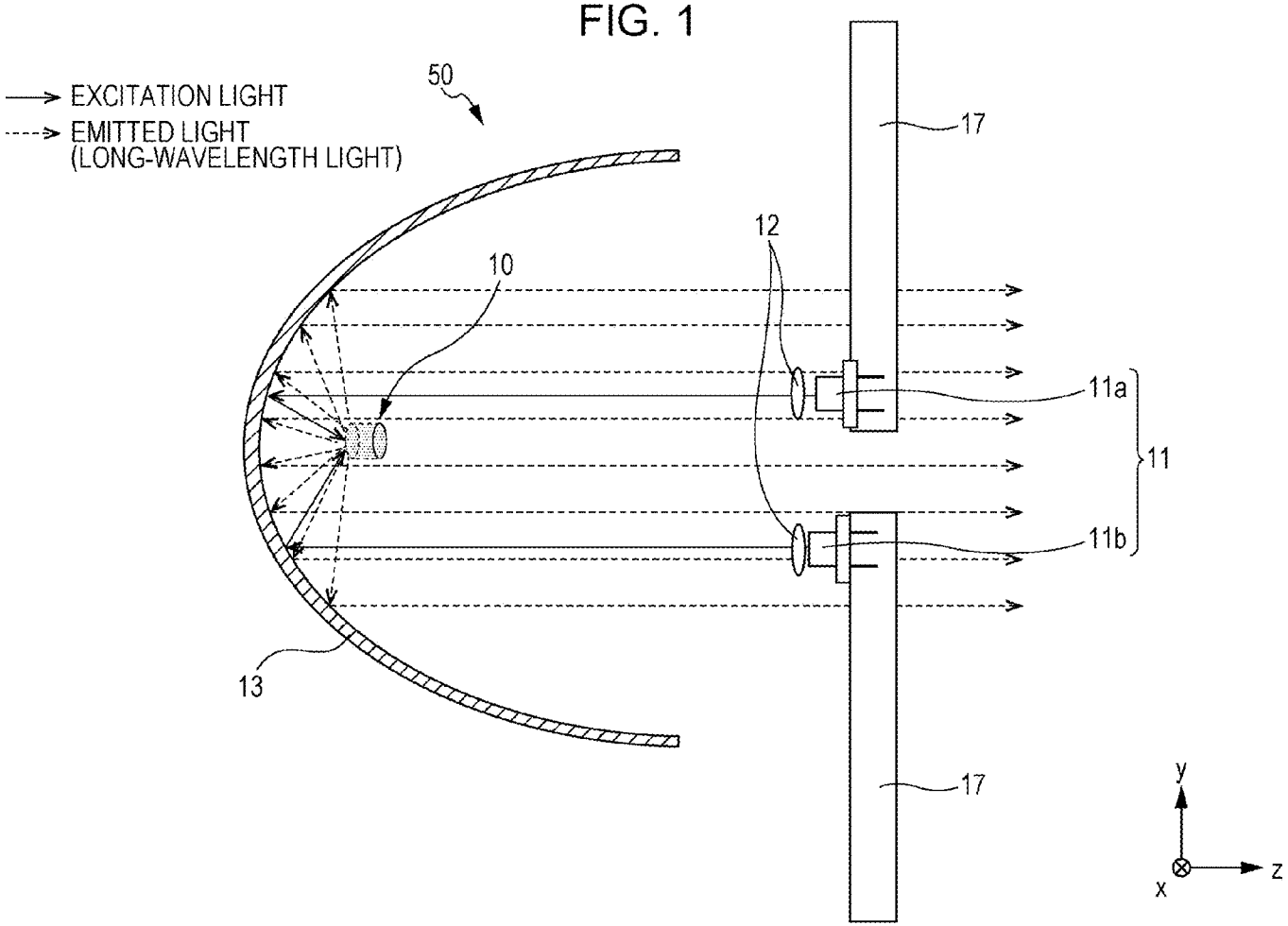
FIG. 1 is a view illustrating a schematic configuration of a lamp in a first embodiment.

The inventors of the present disclosure conducted a comprehensive study and found that a lamp might not properly emit light if a semiconductor laser is vibrated relative to a reflector. The direction of the light emitted from the lamp might be varied or the light emitting portion might not sufficiently emit light, for example.

Lamps in embodiments of the present disclosure properly emit light even when the light source that emits excitation light is vibrated. In addition to this advantage, in some embodiments of the present disclosure, unstable light emission due to an increase in junction temperature of the light source is reduced.

To produce a high-intensity lamp, a high-power semiconductor laser element is commonly required. However, the use of a high-power semiconductor laser element leads to an increase in junction temperature and causes problems such as a change in oscillation wavelength and a decrease in emission efficiency. Particularly, in a vehicle headlamp, a beam profile of the output light is required to be horizontally enlarged. To meet the requirement, an optical component such as a fresnel lens, an aperture, or a cut mirror is generally used to eliminate stray light that travels upward. However, such optical components lead to light loss, whereby the emission efficiency of the lamp is decreased.

To solve the problems, in the embodiments of the present disclosure, semiconductor light-emitting elements are properly positioned and controlled to reduce the increase in the temperature of the semiconductor light-emitting elements. This improves thermal and optical reliability.

A brief description of embodiments of the present disclosure are described below.

(1) A lamp according to an aspect of the present disclosure includes: a plurality of semiconductor light-emitting elements that emit excitation light; a wavelength conversion element that converts the excitation light into light having a peak wavelength different from that of the excitation light; and a concave mirror that reflects the excitation light emitted from the plurality of semiconductor light-emitting elements to the wavelength conversion element and reflects the light from the wavelength conversion element toward an outside of the lamp. The plurality of semiconductor light-emitting elements includes a first semiconductor light-emitting element and a second semiconductor light-emitting element. A distance y1 from an optical axis of the first semiconductor light-emitting element to an optical axis of the concave mirror satisfies $(D+Dphos)/2 \leq y1 \leq 4f$. A distance y2 from an optical axis of the second semiconductor light-emitting element to the optical axis of the concave mirror satisfies $4f < y2 \leq R$. D is a beam diameter of the excitation light, Dphos is a length of the wavelength conversion element in a direction perpendicular to the optical axis of the concave mirror, within a plane including the optical axis of the concave mirror and at least one selected from the optical axes of the first and second semiconductor light-emitting elements, f is a focal distance of the concave mirror, and R is a radius of an opening of the concave mirror.

The optical axis of the first semiconductor light-emitting element is an optical axis of an incident light to the concave mirror, the incident light being the excitation light that travels from the first semiconductor light-emitting element directly to the concave mirror or indirectly to the concave mirror through an optical element such as a mirror or an optical fiber. The optical axis of the second semiconductor light-emitting element is also an optical axis of an incident light to the concave mirror, the incident light being the excitation light that travels from the second semiconductor light-emitting element directly to the concave mirror or indirectly to the concave mirror through an optical element such as a mirror or an optical fiber.

(2) In an embodiment, the wavelength conversion element may include a phosphor that emits light having a peak wavelength longer than that of the excitation light when excited by the excitation light.

(3) In an embodiment, the wavelength conversion element may be positioned such that a section including the phosphor is positioned in a focal area of the concave mirror.

(4) In an embodiment, a center of a surface of the section including the phosphor may be positioned in the focal area of the concave mirror.

(5) In an embodiment, the plurality of semiconductor light-emitting elements each may be positioned to emit the excitation light parallel to the optical axis of the concave mirror, and the wavelength conversion element may be positioned so as not to block the excitation light traveling from the plurality of semiconductor light-emitting elements to the concave mirror.

(6) In an embodiment, the wavelength conversion element may be positioned on the optical axis of the concave mirror. In a projection view in which the plurality of semiconductor light-emitting elements and the wavelength conversion element are projected onto a plane extending perpendicular to the optical axis of the concave mirror, one of the plurality of semiconductor light-emitting elements may be adjacent to the wavelength conversion element in a first direction and another one of the plurality of semiconductor light-emitting elements may be adjacent to the wavelength conversion element in a second direction that is perpendicular to the first direction.

(7) In an embodiment, the concave mirror may have a reflection surface having a shape formed by rotating a parabola.

(8) In an embodiment, the concave mirror may have a reflection surface having a shape formed by rotating a segment of an ellipse.

(9) In an embodiment, the concave mirror may have a reflection surface having a shape formed by rotating a segment of a hyperbola.

(10) In an embodiment, the concave mirror may have a reflection surface having a shape formed by rotating a segment of a non-linear curve.

(11) In an embodiment, the lamp may further include a control circuit that activates the plurality of semiconductor light-emitting elements such that the first semiconductor light-emitting element and the second semiconductor light-emitting element alternately emit the excitation light.

(12) In an embodiment, the control circuit may activate the first semiconductor light-emitting element and the second semiconductor light-emitting element such that the second semiconductor light-emitting element emits the excitation light for a longer time than the first semiconductor light-emitting element.

(13) A vehicle headlamp according to another aspect of the present disclosure includes the lamp according to any one of the above-described aspects (1) to (12).

Hereinafter, specific embodiments of the present disclosure are described.

First Embodiment

FIG. 1 is a view illustrating a schematic configuration of a light source lamp (hereinafter, referred to as a "lamp") in a first embodiment of the present disclosure. A lamp 50 of this embodiment includes a wavelength conversion element 10, a plurality of semiconductor light-emitting elements 11, and a concave mirror 13. In the following description, the semiconductor light-emitting element may be referred to as a "light-emitting element". The light-emitting element 11 may be an LED, a super luminescent diode (SLD), or a laser diode (LD), for example. In this embodiment, the light-emitting elements 11 include two laser diodes as light-emitting elements 11*a* and 11*b*, for example. The light-emitting elements 11 are positioned such that laser rays emitted therefrom travel parallel to an optical axis of the concave mirror 13 toward the concave mirror 13 without being blocked by the wavelength conversion element 10. The "optical axis" of the concave mirror 13 is a straight line extending through the center (top) and the focal point of the concave mirror 13. The optical axis of the concave mirror 13 is coincident with a line normal to a plane in contact with the top of the concave mirror 13. In the following description, x-y-z coordinates indicated in FIG. 1 are used. The z direction is a direction of the optical axis of the concave mirror 13. The y direction is a direction intersecting the optical axis and extending toward the light-emitting elements 11. The x direction is a direction perpendicular to the z direction and the y direction.

Figure 2:
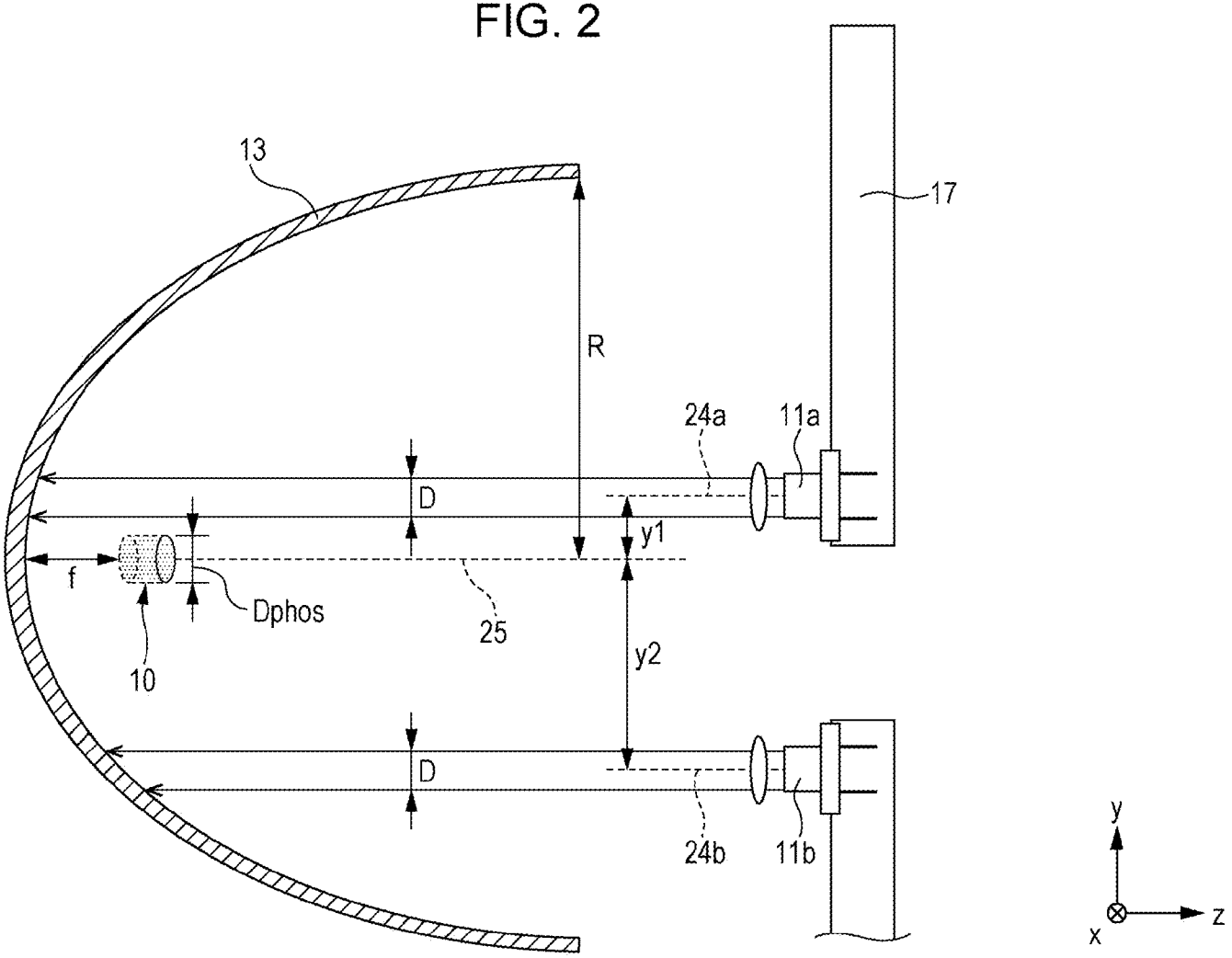
FIG. 2 is a view illustrating a positional relationship of components of the lamp in the first embodiment.

FIG. 2 is a view illustrating a positional relationship of the light-emitting elements 11*a* and 11*b*, the wavelength conversion element 10, and the concave mirror 13. The beam diameter of the excitation light is D, the length of the wavelength conversion element 10 in the direction perpendicular to the optical axis 25 of the concave mirror 13 within a plane including the optical axis 25 of the concave mirror 13 and the optical axes 24*a* and 24*b* of the first and second semiconductor light-emitting elements is Dphos, the focal distance of the concave mirror 13 is f, and the radius of the opening of the concave mirror 13 is R. The distance y1 between the optical axis 24*a* of the light-emitting element 11*a* and the optical axis 25 of the concave mirror 13 satisfies $(D+Dphos)/2 \leq y1 \leq 4f$, for example. The distance y2 between the optical axis 24*b* of the light-emitting element 11*b* and the optical axis 25 of the concave mirror 13 satisfies $4f < y2 \leq R$, for example.

Satisfying the above-described conditions reduces an increase in the temperature due to the heat generated by the lamp 50 and elongates the beam profile of the light emitted from the lamp 50 in the horizontal direction. These advantages are obtained without using an optical component such as a lens, or an aperture, which may lead to large optical loss. As a result, stable light emission with high efficiency is achieved.

As illustrated in FIG. 1, the light-emitting elements 11 may be fixed to a case (or a housing) of the lamp 50 by supporting members 17.

The light-emitting elements 11 are configured to emit blue-violet light or blue light, for example. However, the light-emitting elements 11 should not be limited to this configuration and may be configured to emit any other light. In the present disclosure, "blue-violet light" has a peak wavelength (i.e. wavelength of the peak intensity) of more than 380 nm and 420 nm or less. The "blue light" has a peak wavelength of more than 420 nm and less than 480 nm. The light emitted from the light-emitting elements 11 excites the wavelength conversion element 10. Thus, the light emitted from the light-emitting element 11 may be referred to as "excitation light".

As illustrated in FIG. 1, an incidence optical system 12 that guides the light from the light-emitting elements 11 to the wavelength conversion element 10 may be provided between the wavelength conversion element 10 and the light-emitting element 11. The incidence optical system 12 may include a lens, a mirror, and/or an optical fiber, for example.

The concave mirror 13 is positioned so as to reflect the excitation light from the light-emitting element 11 to the wavelength conversion element 10. The concave mirror 13 also reflects the light from the wavelength conversion element 10 excited by the excitation light to the outside of the lamp 50. In other words, wavelength-converted light reflected by the concave mirror 13 is released to the outside of the lamp 50. The concave mirror 13 has a shape formed by rotating a parabola, for example. The shape formed by rotating a parabola is a curved surface (paraboloid) obtained by rotating a parabola around its axis of symmetry. The concave mirror 13 may have a shape formed by rotating a segment of an ellipse, a hyperbola, or any non-linear curve, instead of a shape formed by rotating a parabola. Herein, "shape formed by rotating a segment" is a shape of a part of a curved surface obtained by rotating a curved line around its axis of symmetry.

The wavelength conversion element 10 is positioned on or near the focal point of the concave mirror 13. The wavelength conversion element 10 changes the wavelength of the excitation light to a different wavelength. The wavelength conversion element 10 emits light due to the excitation light reflected by the concave mirror 13.

Figure 3:
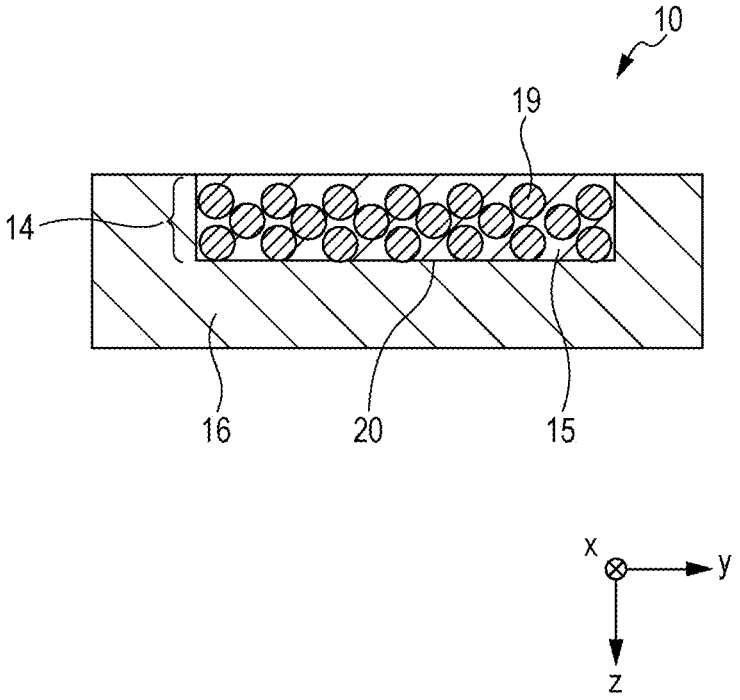
FIG. 3 is a view illustrating a schematic configuration of a wavelength conversion element in the first embodiment.

FIG. 3 is a cross-sectional view illustrating a schematic configuration of the wavelength conversion element 10 in this embodiment. The wavelength conversion element 10 includes a phosphor layer 14 and a holder 16. The phosphor layer 14 has a cylindrical shape, a disc-like shape, or a cuboidal shape, for example. The phosphor layer 14 may have any other shape. The wavelength conversion element 10 is positioned such that a center section of a front surface (upper surface in FIG. 3) of the phosphor layer 14 is in a focal area of the concave mirror 13. The "focal area" is an area within a distance of about f/5 or less from the focal point, in which f is the focal length. When the focal length f is 0.5 mm, for example, an area within a distance of 100 μm or less from the focal point is the focal area. To reduce an increase in the temperature at a part of the phosphor layer 14 positioned at the focal point, a light collecting area may be expanded by positioning the front surface of the phosphor layer 14 away from the focal point of the concave mirror 13. The front surface of the phosphor layer 14 may be positioned away from the focal point in a front direction (+z direction) or a rear direction (−z direction) by about 10 μm to about 100 μm, for example.

The phosphor layer 14 converts the excitation light from the light-emitting elements 11 into light of a longer wavelength. As illustrated in FIG. 3, the phosphor layer 14 may include phosphor powder 19 and a bonding material 15. When the light-emitting elements 11 emit blue-violet light, the phosphor layer 14 includes a yellow phosphor and a blue phosphor, for example. In the present disclosure, the "yellow phosphor" has an emission spectrum peak wavelength of 540 nm or more and 590 nm or less. The yellow phosphor may be a combination of a green phosphor, which emits green light, and a red phosphor, which emits red light. The "blue phosphor" has an emission spectrum peak wavelength of 420 nm or more and 480 nm or less. The mixture of the yellow phosphor and the blue phosphor allows the lamp 50 to emit substantially white light to the outside of the lamp 50. In the light-emitting elements 11 that emit blue light, the phosphor layer 14 includes the yellow phosphor, for example. The mixture of the yellow phosphor and the blue light as the excitation light allows the lamp 50 to emit substantially white light to the outside of the lamp 50.

The phosphor powder 19 includes a plurality of phosphor particles. The bonding material 15 between the phosphor particles bonds the phosphor particles. The bonding material 15 is an inorganic material, for example. The bonding material 15 may be a medium such as a resin, a glass, or a transparent crystal. The phosphor layer 14 may be a sintered phosphor without the bonding material 15, i.e., a phosphor ceramic.

As illustrated in FIG. 3, the phosphor layer 14 may be supported by the holder 16. The holder 16 supports the bottom surface of the phosphor layer 14 and surrounds the side surface of the phosphor layer 14. The bottom surface of the phosphor layer 14 is a surface (lower surface in FIG. 3) opposite to the surface that receives the light emitted from the light-emitting elements 11 and reflected by the concave mirror 13. The side surface of the phosphor layer 14 is a surface extending around the bottom surface. In the embodiment illustrated in FIG. 3, an area of the phosphor layer 14 that is in contact with the holder 16 is larger than an area thereof that is not in contact with the holder 16. This configuration facilitates heat release from the phosphor layer 14. The holder 16 has a hollow cylindrical shape having a central axis, a thick side wall, and a disc-shaped bottom surface, for example. The central axis of the holder 16 is substantially coincident with the central axis of the cylindrical phosphor layer 14. The thick side wall has substantially the same height as that of the phosphor layer 14. The bottom surface supports the phosphor layer 14. The shape of the holder 16 should not be limited to the hollow cylindrical shape and may be any shape. The holder 16 is formed of a material having a thermal conductivity of 42 W/m° C. or more, for example. The holder 16 may be formed of an inorganic material, a metal, a resin, a glass, or a transparent crystal. When the holder 16 is formed of a light transmissive material, a reflection layer 20 that reflects the light from the phosphor layer 14 may be provided between the phosphor layer 14 and the holder 16. This configuration increases the amount of light to be emitted from the phosphor layer 14 to the concave mirror 13, and thus light extraction efficiency is improved. The reflection layer 20 may be a thin film of metal such as silver or aluminum, or a Distributed Bragg Reflector (DBR).

Next, an operation of the lamp 50 is described with reference to FIG. 1 again. The light-emitting elements 11 emit the excitation light. The excitation light is reflected by the concave mirror 13 to enter the wavelength conversion element 10. The excitation light allows the phosphor of the wavelength conversion element 10 to emit the wavelength-converted light having a wavelength longer than that of the excitation light. The wavelength-converted light is reflected by the concave mirror 13 and released to the outside of the lamp 50.

If the lamp 50 is used as a vehicle lamp, the lamp 50 might be vibrated. Under vibrations, the positional relationship of the light-emitting elements 11 and the concave mirror 13 is altered. As a result, the concave mirror 13 receives the excitation light at different positions. The concave mirror 13 of the present embodiment has a curved surface that guides the excitation light reaching any positions of the concave mirror 13 to the wavelength conversion element 10. Thus, the wavelength conversion element 10 appropriately receives the excitation light even when the lamp 50 is vibrated. As a result, the wavelength-converted light is appropriately released from the lamp 50.

Second Embodiment

Figure 4:
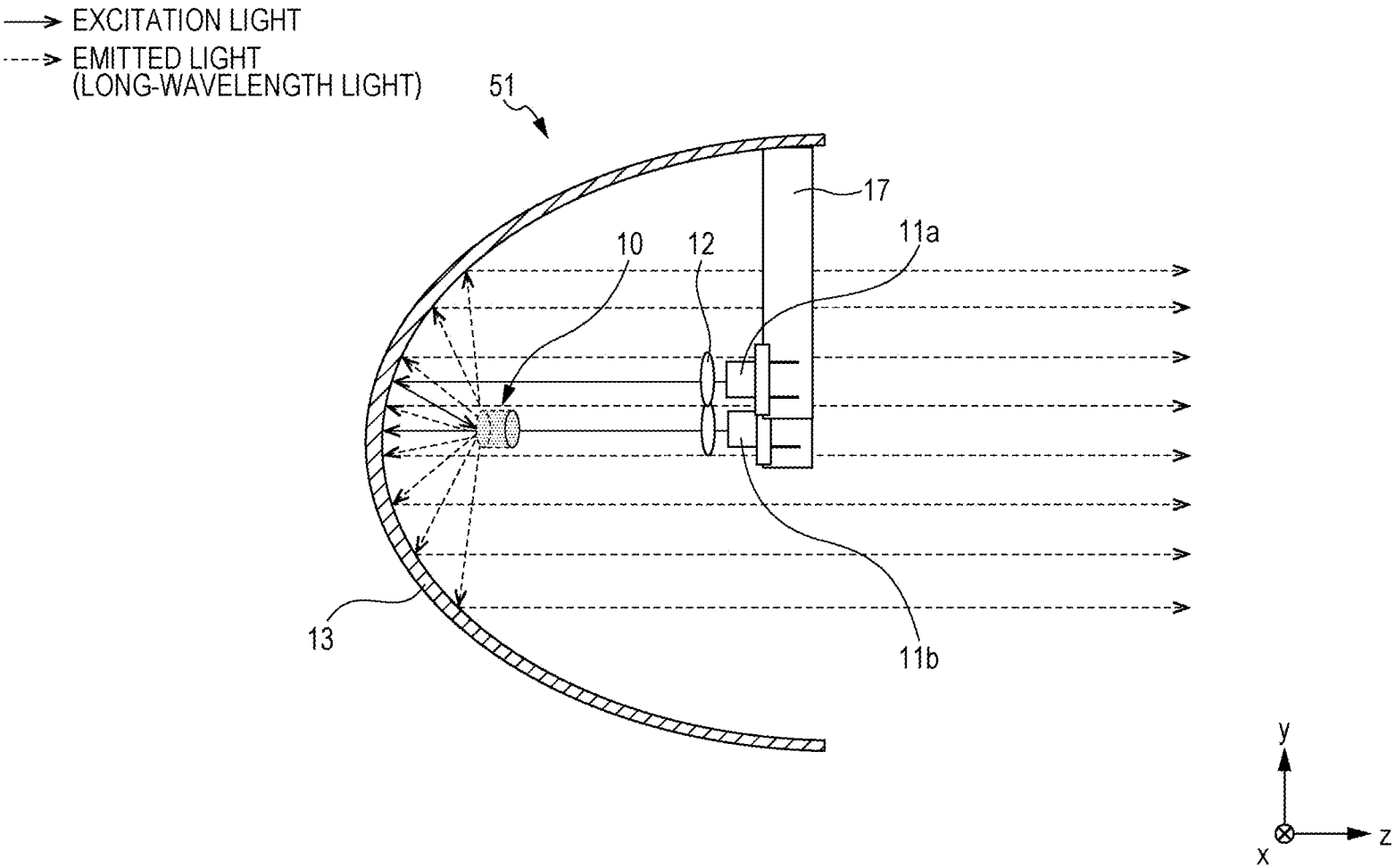
FIG. 4 is a view illustrating a schematic configuration of the lamp in a second embodiment.

FIG. 4 is a view illustrating a schematic configuration of a lamp 51 in a second embodiment of the present disclosure. The same components as those in the above-described first embodiment are assigned the same reference numerals as the first embodiment, and the explanation thereof is omitted. In the lamp 51 of this embodiment, the light-emitting elements 11 include a first light-emitting element 11*a* and a second light-emitting element 11*b*. The first light-emitting element 11*a* and the second light-emitting element 11*b* are supported on the supporting members 17 at an upper portion and a side portion of the concave mirror 13, respectively. The "upper portion" is positioned at an upper side (+y direction) in FIG. 4. The "side portion" is positioned farther from the viewer (+x direction) in FIG. 4. The other components and the operation are the same as those in the first embodiment.

Figure 5:
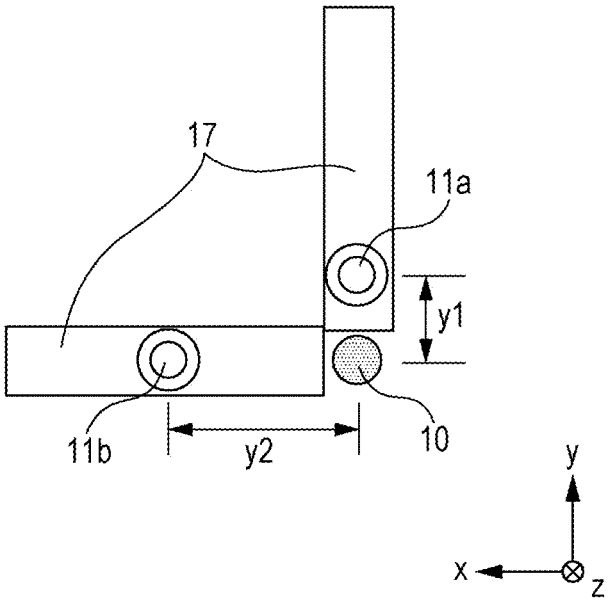
FIG. 5 is a view illustrating a positional relationship between two light-emitting elements of the lamp in the second embodiment.

FIG. 5 is a projection view illustrating a positional relationship of the light-emitting elements 11*a* and 11*b* and the wavelength conversion element 10 of the present embodiment. In FIG. 5, the light-emitting elements 11*a* and 11*b* and the wavelength conversion element 10 are projected onto a plane extending perpendicular to the optical axis of the concave mirror 13. The light-emitting elements 11*a* and 11*b* and the wavelength conversion element 10 are viewed from the side of the concave mirror 13 in the +z direction. In this projection plane, the first light-emitting element 11*a* is adjacent to the wavelength conversion element 10 in a first direction (y direction) and the second light-emitting element 11*b* is adjacent to the wavelength conversion element 10 in the second direction (x direction). The second direction is perpendicular to the first direction.

In this embodiment, a distance y1 from the optical axis of the first light-emitting element 11*a* to the optical axis of the concave mirror 13 satisfies the following condition (1), for example.

$$(D+D\text{phos})/2 \leq y1 \leq 4f \quad (1)$$

In addition, a distance y2 from the optical axis of the second light-emitting element 11*b* to the optical axis of the concave mirror 13 satisfies the following condition (2), for example.

$$4f < y2 \leq R \quad (2)$$

In the above-described conditions, D is a beam diameter of the excitation light, Dphos is a length (diameter in FIG. 5) of the wavelength conversion element 10 that is measured in a direction perpendicular to the optical axis of the concave mirror 13 within a plane including the optical axis of the concave mirror 13 and at least one selected from the optical axes of the first and second semiconductor light-emitting elements 11*a* and 11*b*, f is a focal distance of the concave mirror 13, and R is a radius of the opening of the concave mirror 13. In this embodiment, the distance y2 is measured in the x direction, but the symbol "y2" is used for convenience of the comparison with FIG. 2.

With this configuration, as will be described in a second example, the beam profile of the output light can be elongated horizontally (±x direction). The use of the lamp 51 as a vehicle headlamp reduces stray light that may shine on the driver of the oncoming car.

In addition, as in the first embodiment, the present embodiment can maintain high stability under vibrations.

Third Embodiment

Figure 6:
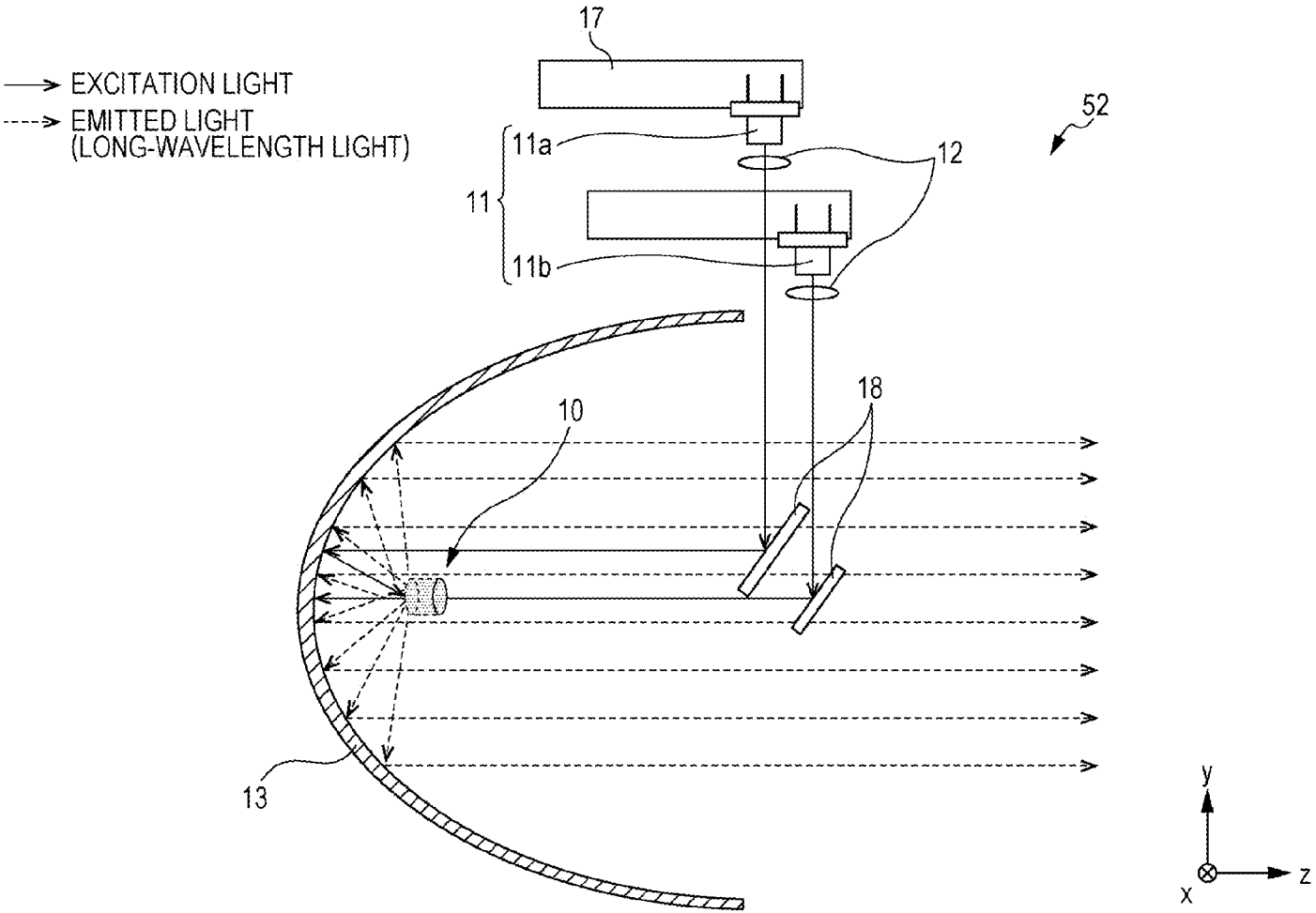
FIG. 6 is a view illustrating a schematic configuration of a lamp in a third embodiment.

FIG. 6 is a view illustrating a schematic configuration of a lamp 52 in a third embodiment of the present disclosure. The same components as those in the above-described second embodiment are assigned the same reference numerals as in the second embodiment, and the explanation thereof is omitted. The lamp 52 of this embodiment includes the light-emitting elements 11 at positions outside the concave mirror 13. The light-emitting elements 11 are supported by the supporting members 17 and fixed to the case (or housing). The lamp 52 further includes two reflective mirrors 18 that guide the excitation light from the light-emitting elements 11 to the reflection surface of the concave mirror 13.

The reflective mirror 18 may be a dichroic mirror. The reflective mirror 18 reflects the light having a wavelength equal to or shorter than an emission wavelength of the light-emitting elements 11 and allows light having a wavelength longer than the emission wavelength to pass therethrough. With this configuration, the reflective mirror 18 reflects the excitation light from the light-emitting elements 11 toward the concave mirror 13 and allows the light emitted from the wavelength conversion element 10 to pass therethrough. Thus, the light is unlikely to return to the light-emitting element 11. The center (i.e., optical axis) of the light incident on the concave mirror 13 after being emitted from the light-emitting elements 11 and reflected by the reflective mirror 18 is referred to as the optical axis of the light-emitting elements 11*a* and 11*b*.

The two reflective mirrors 18 are placed at positions corresponding to the light-emitting elements 11*a* and 11*b* as illustrated in FIG. 6, for example. The two light-emitting elements 11*a* and 11*b* are positioned above the two reflective mirrors 18 in the vertical direction (+y direction). With this configuration, this embodiment can obtain the same advantages as the second embodiment.

In this embodiment, since the light-emitting elements 11 are positioned outside the concave mirror 13, heat generated by the light-emitting elements 11 is effectively released to the outside of the lamp 52. This reduces a decrease in emission efficiency resulting from an increase in the temperature.

In the lamp 52 that is used as a vehicle headlamp, the distance y2 from the center of light beam emitted from the second light-emitting element 11*b*, which is positioned away from the optical axis of the concave mirror 13 in the horizontal direction (+x direction), to the optical axis of the concave mirror 13 satisfies $4f<y2\leq R$. This configuration elongates the beam profile of the output light from the concave mirror 13 in the horizontal direction and reduces the stray light that may shine on the driver of the oncoming car. The other configurations and operations of this embodiment are the same as those of the second embodiment.

Fourth Embodiment

Figure 7:
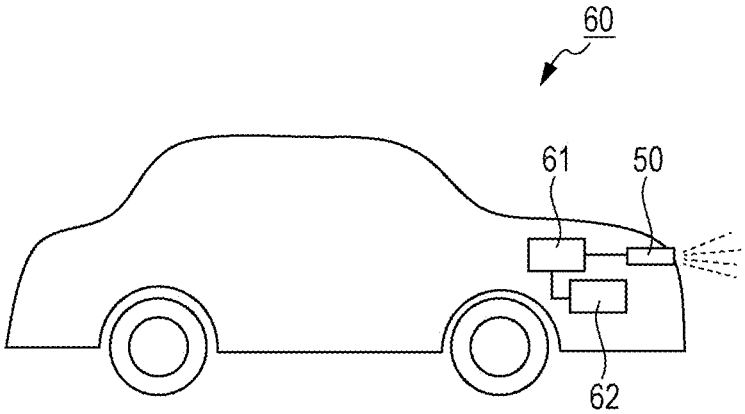
FIG. 7 is a view illustrating a schematic configuration of a vehicle in a fourth embodiment.

FIG. 7 is a view illustrating a schematic view of a vehicle 60 in a fourth embodiment of the present disclosure. The vehicle 60 includes the lamp 50 according to the first embodiment and a power supply source 61. The vehicle 60 may include a power generator 62 that generates electric power when rotated by a drive source such as an engine. The electric power generated by the power generator 62 is stored in the power supply source 61. The power supply source 61 is a secondary battery that is rechargeable. The lamp 50 of this embodiment is a vehicle headlamp. The lamp 50 is turned on by the power supplied by the power supply source 61. The vehicle 60 may be an automobile, a motorcycle, or a specialized vehicle. The vehicle 60 also may be an engine automobile, an electric automobile, or a hybrid automobile. Instead of the lamp 50 according to the first embodiment, the lamp 51 or 52 according to the second or third embodiment may be used.

The present embodiment reduces variations of the light emitted from the lamp that is vibrated in a moving vehicle, and thus automobile safety is improved.

First and Second Examples

With the configurations in the embodiments of the present disclosure, the lamp can stably emit light even when vibrated in a moving vehicle, for example. With the configurations in the second and third embodiments, the beam profile of the output light from the lamp can be changed without using an optical component such as a fresnel lens or an aperture, which may lead to large optical loss. To ensure these advantages, the inventors of the present disclosure carried out optical simulations using a ray tracing method. In the optical simulation, Light Tools produced by Cybernet Systems Co., Ltd was used.

Figure 8:
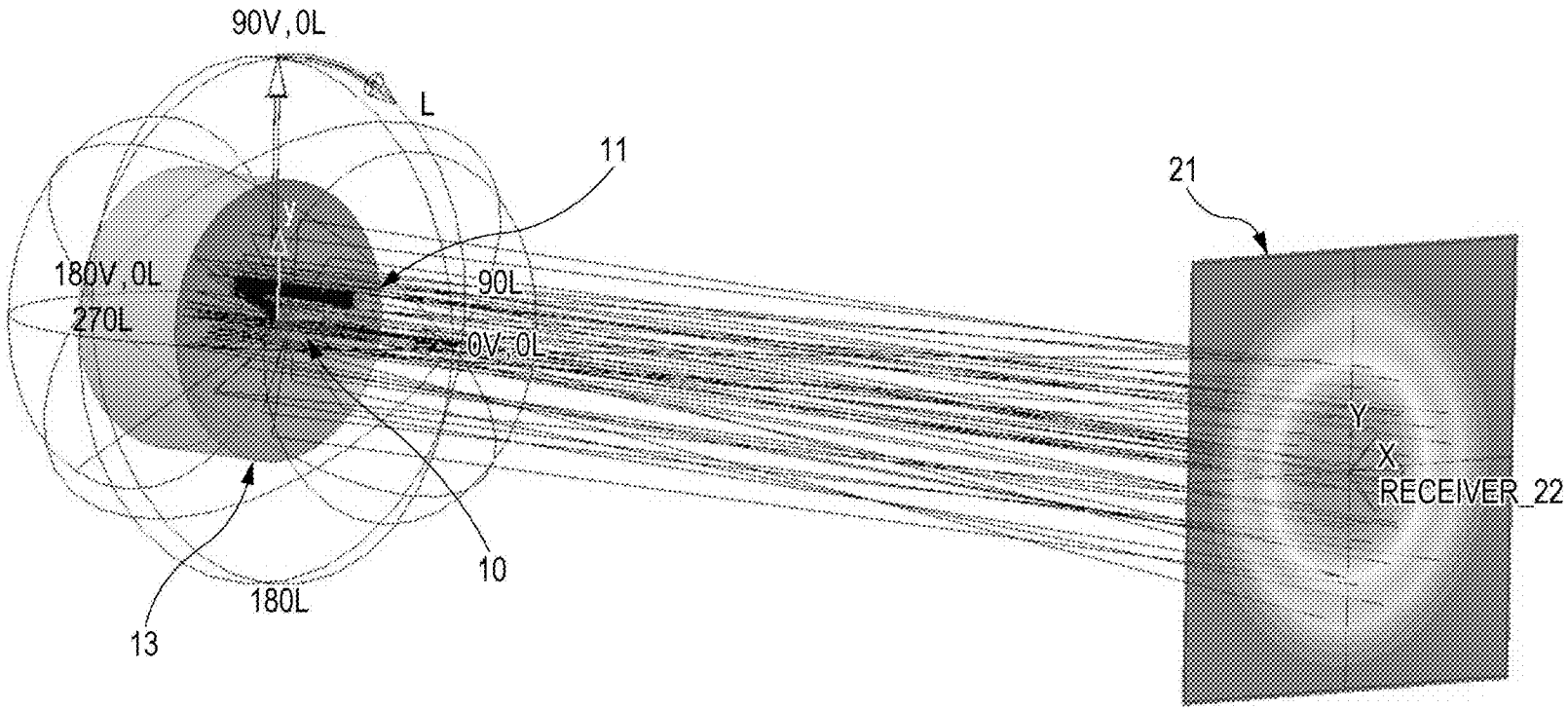
FIG. 8 is a view showing an optical simulation result of a lamp in a comparative example in the present disclosure.
Figure 9:
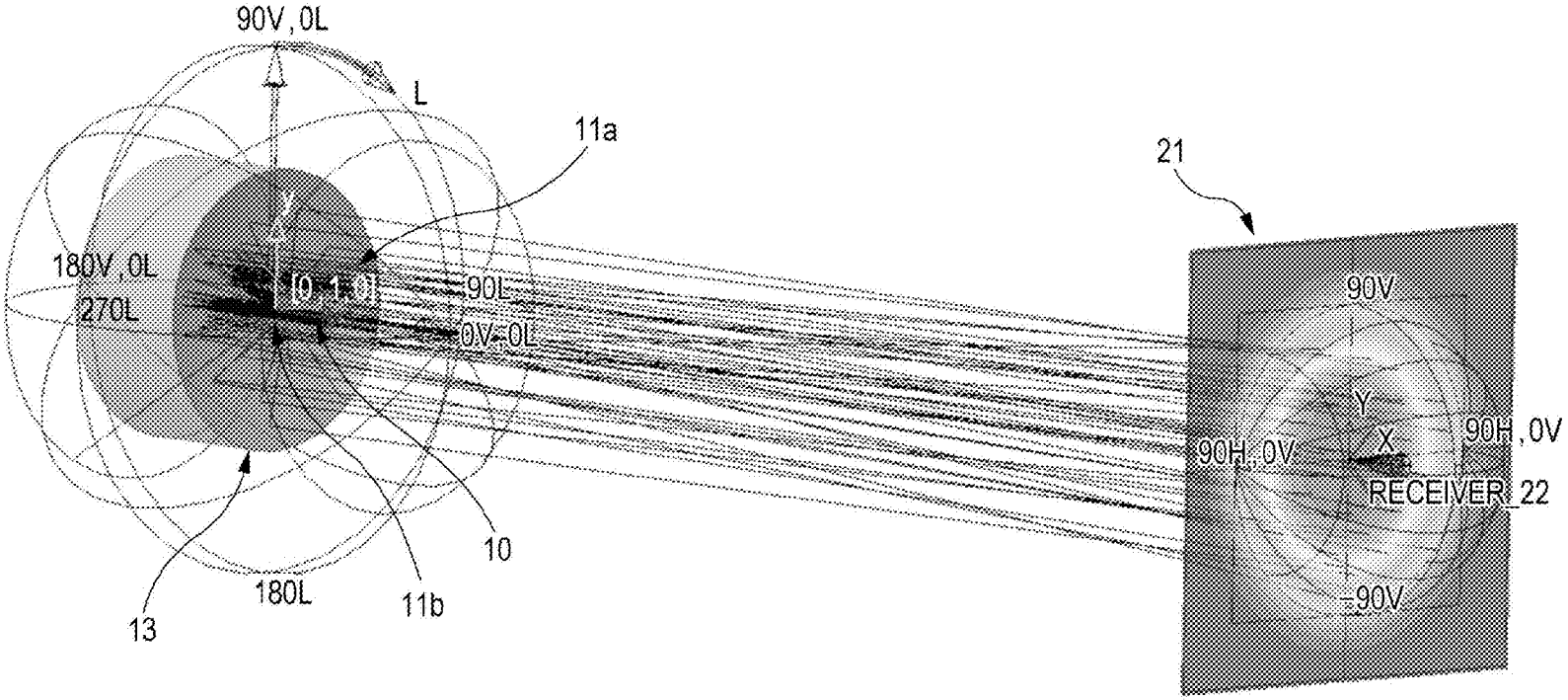
FIG. 9 is a view showing an optical simulation result of a lamp in a first example of the present disclosure.
Figure 10:
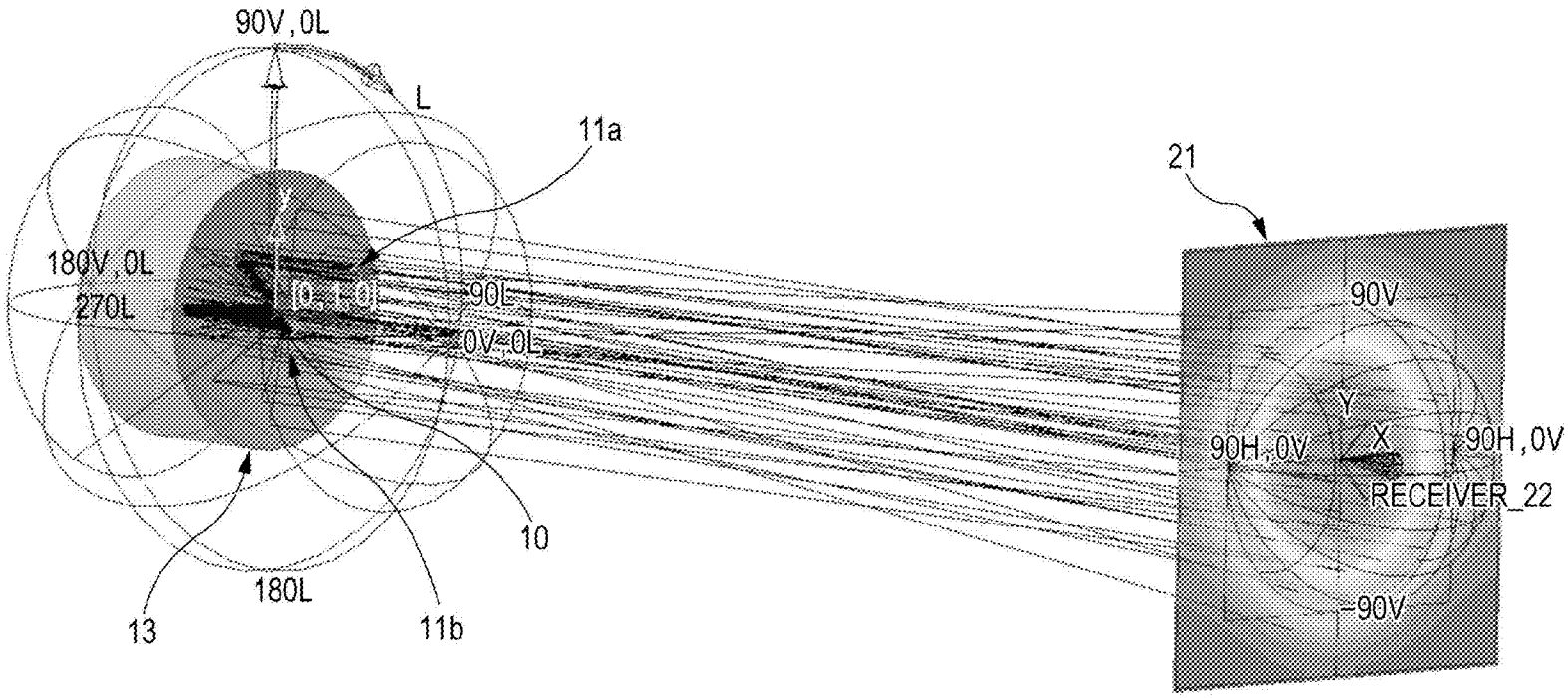
FIG. 10 is a view showing an optical simulation result of a lamp in a second example of the present disclosure.

FIG. 8, FIG. 9, and FIG. 10 show simulation results of a comparative example, a first example, and a second example, respectively. In a model of the optical simulations, circular surface light sources each having a diameter of 0.6 mm were used as the light-emitting elements 11, which is the excitation light source. An output direction of a light ray is perpendicular to a plane that is in contact with the top of the concave mirror 13 (i.e. parallel to the optical axis of the concave mirror 13). The output range of the excitation light from each of the light-emitting elements 11 is a circular range having a diameter of 0.6 mm, and the collimated semiconductor laser light having a beam diameter D of 0.6 mm was simulated. As the concave mirror 13, a parabolic mirror having an opening diameter R of 9 mm and a focal distance f of 0.5 mm was used. As the wavelength conversion element 10, a circular disc-shaped element having a diameter Dphos of 1.2 mm was placed in the focal area of the concave mirror 13 so as to be parallel to the plane that is in contact with the top of the concave mirror 13. The wavelength conversion element 10 emits light due to Lambertian scattering occurring on the surface of the circular disc. At a position away from the opening of the concave mirror 13 by 50 mm, a light receiver 21 was placed to check the beam profile of the output light that travels from the concave mirror 13 to the front of the lamp. A light receiving surface of the light receiver 21 is parallel to the plane that is in contact with the top of the concave mirror 13.

FIG. 8 shows the simulation result of the comparative example. In this comparative example, one light-emitting element 11 was placed such that the center point of the light emitting surface thereof is positioned above the focal point on the optical axis of the concave mirror 13 by 1 mm. A light output of the light-emitting element 11 was set at 1 W, and 50,000 light rays that were supposed to be emitted from the light-emitting element 11 were traced.

As illustrated in FIG. 8, the light rays were concentric with each other on the light receiving surface of the light receiver 21 about an intersection point between the optical axis of the concave mirror 13 and the light receiving surface. In this comparative example, the optical beam, which has the beam diameter of 0.6 mm, was emitted from the light-emitting element 11 and reflected by the concave mirror 13, and then was allowed to enter the wavelength conversion element 10 that was positioned in the focal area. On the surface of the wavelength conversion element 10, the Lambertian scattering occurred. The generated light was reflected by the concave mirror 13 again and entered the light receiver 21. As can be seen from the result in FIG. 8, the beam profile of the light entering the light receiver 21 has high uniformity.

FIG. 9 illustrates the simulation result of the first example. In this example, two light-emitting elements 11*a* and 11*b* were used. The light-emitting element 11*a* was placed such that the center point of the light emitting surface thereof was positioned above the focal point on the optical axis of the concave mirror 13 by 1 mm. The light-emitting element 11*b* was placed such that the center point of the light emitting surface thereof was positioned away in a horizontal direction from the focal point on the optical axis of the concave mirror 13 by 1 mm. A light output of each light-emitting element 11*a* and 11*b* was set at 0.5 W, and 25,000 light rays that were supposed to be emitted from the light-emitting elements 11 were traced. As illustrated in FIG. 9, a preferable result was obtained. As the result in FIG. 8, the light rays were concentric with each other on the light receiving surface of the light receiver 21 about the intersection between the optical axis of the concave mirror 13 and the light receiving surface.

If a distance y from the optical axis of the concave mirror 13 to the light-emitting element 11*a* or 11*b* is too small, the light ray from the light-emitting element 11 is likely to be blocked by the wavelength conversion element 10. To prevent this, the distance y from the optical axis of the concave mirror 13 to the light-emitting element 11*a* or 11*b* satisfies (D+Dphos)/2≤y in which D is the beam diameter of the excitation light, Dphos is the diameter of the wavelength conversion element, and f is the focal point of the concave mirror. Satisfying this condition improves light emission efficiency of the lamp 50. The range of y in this example is 0.9 mm≤y≤2 mm.

FIG. 10 shows the simulation result of the second example. In this example, the light-emitting elements 11*a* and 11*b* were positioned differently from those in the first example. The light-emitting element 11*a* was placed such that the center point of the light emitting surface thereof was positioned above the focal point on the optical axis of the concave mirror 13 by 1.5 mm. The light-emitting element 11*b* was placed such that the center point of the light emitting surface thereof was positioned away horizontally from the focal point on the optical axis of the concave mirror 13 by 3 mm. A light output of the light-emitting element 11*a* positioned above the focal point was set at 0.4 W, the light output of the light-emitting element 11*b* positioned away horizontally from the focal point was set at 0.6 W, and 25,000 light rays that were supposed to be emitted from each light-emitting element 11 were traced.

As illustrated in FIG. 10, compared to the distribution in FIG. 9, the light rays were distributed in an elliptical shape extending in the horizontal direction. This results from that a distance y2 from the light-emitting element 11*b*, which was positioned away horizontally from the optical axis of the concave mirror 13, to the optical axis was longer. The larger the value of y2 is, the larger the incident angle of the light ray, which is incident on the front surface of the wavelength conversion element 10, is. In the range of 4f<y2≤R, the irradiation profile of the light rays on the front surface of the wavelength conversion element 10 is twisted in an 8-like shape. Since this embodiment satisfies 4f<y≤R, the irradiation profile is twisted. The light-emitting element 11*a*, which was positioned above the focal point on the optical axis of the concave mirror 13 by 1.5 mm, satisfies (D+Dphos)/2≤y≤4f. Thus, the beam profile of the light emitted from the light-emitting element 11*a* is not twisted, and is a concentric circle. In this example, two beam profiles were synthesized by the concave mirror 13, and thus the distribution of the light entering the light receiver 21 has an elliptical shape extending in the horizontal direction.

Figure 11A:
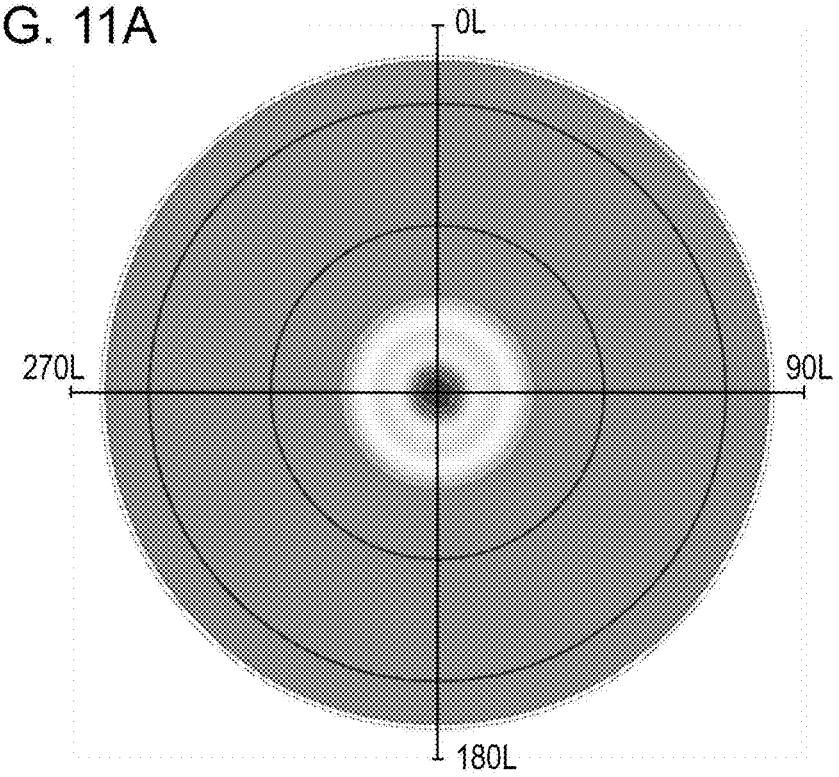
FIG. 11A is a view showing a beam profile of output light from the concave mirror of the lamp in the first example of the present disclosure.
Figure 11B:
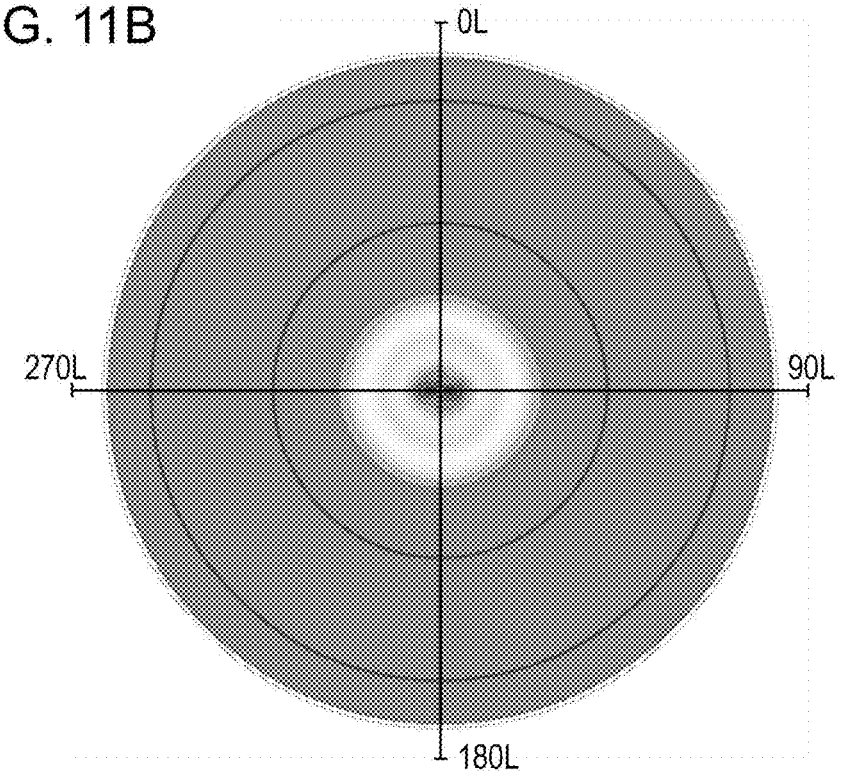
FIG. 11B is a view showing a beam profile of output light from the concave mirror of the lamp in the second example of the present disclosure.

FIG. 11A and FIG. 11B are distribution charts showing beam profiles of the output light (angular dependence of intensity) in the first example and the second example, respectively. As can be seen from the distribution charts, in the second example, the distribution of the output light is elongated in the horizontal direction (lateral direction in FIG. 11B). The second example shows that the beam profile can be elongated in the horizontal direction without the optical components such as a fresnel lens, an aspheric lens, and an aperture, which may lead to optical loss.

Third Example

Next, a third example is described. In this example, the same optical components as those in the second example were used. The light-emitting elements 11*a* and 11*b* were alternately activated and running durations thereof were controlled to be different from each other such that an increase in the temperature of the light-emitting elements was reduced.

Figure 12:
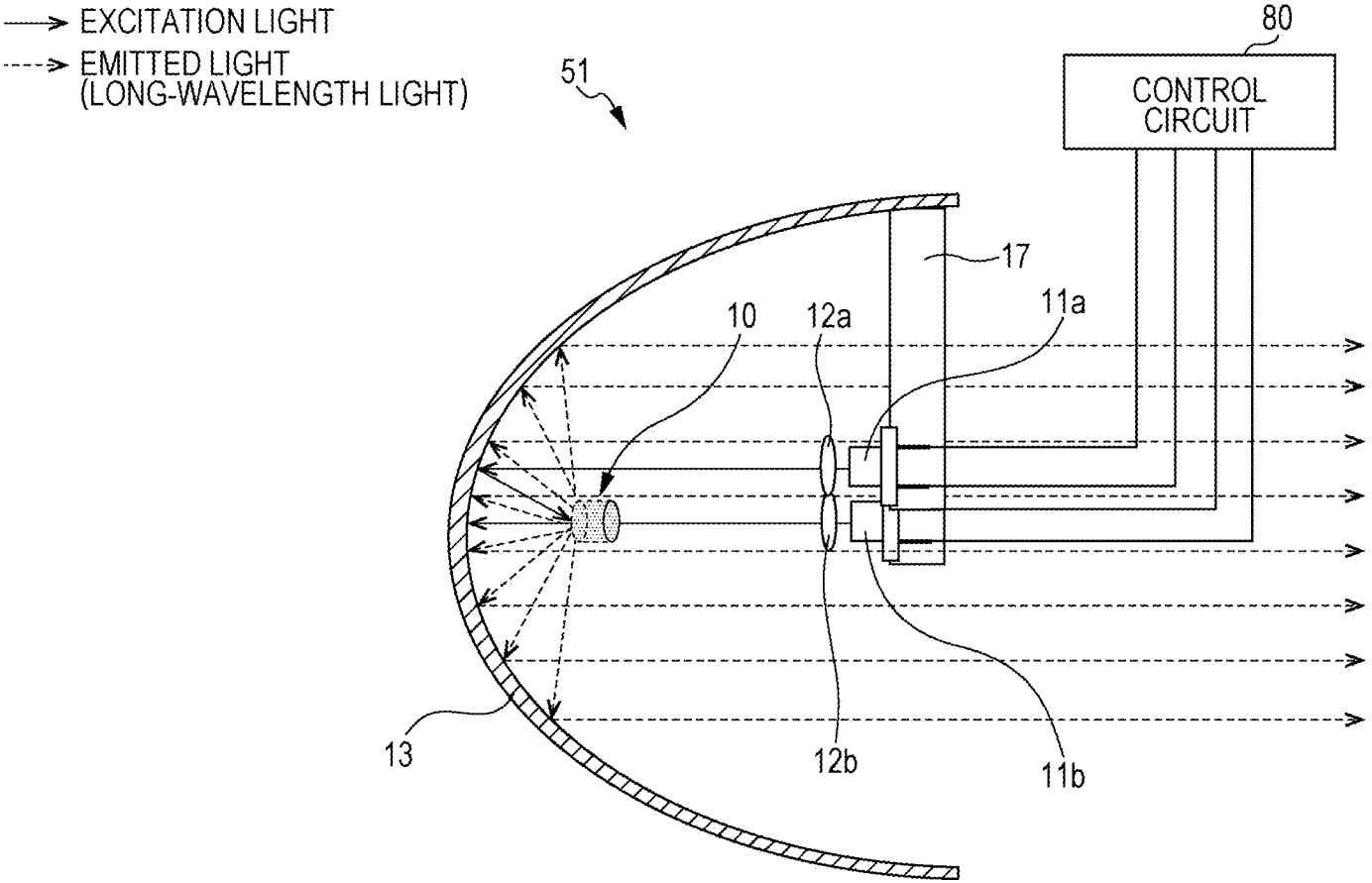
FIG. 12 is a view illustrating a schematic configuration of a lamp in a third example of the present disclosure.

FIG. 12 is a view illustrating a schematic configuration of a lamp 51 in this example. The lamp 51 includes the same optical configuration as that in the second embodiment. The lamp 51 further includes a control circuit 80 that controls timing of light emission of the light-emitting elements 11*a* and 11*b*. The control circuit 80 is electrically connected to the light-emitting elements 11*a* and 11*b* to transmit a drive signal (or pulse), which is a light emission instruction, to the light-emitting elements 11*a* and 11*b*. The control circuit 80 may include a microcomputer or a logic circuit to generate a drive signal, which is described later.

Figure 13:
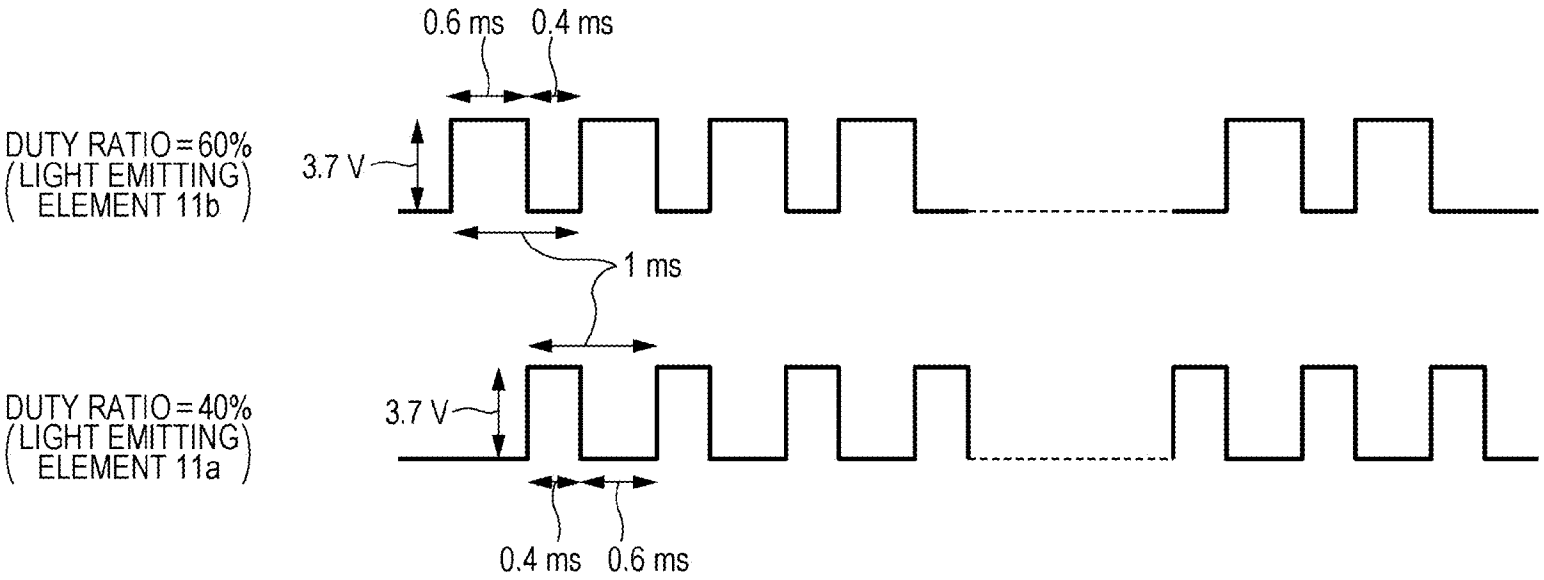
FIG. 13 is a view showing a drive waveform of the lamp in the third example of the present disclosure.

FIG. 13 shows a waveform of a drive signal that is transmitted from the control circuit 80 to activate the light-emitting elements 11*a* and 11 *b*. In this example, blue laser diodes NDB7A75, produced by Nichia Corporation, were used as the light-emitting elements 11*a* and 11*b*. The optical system was the same as that in the second example. As the wavelength conversion element, a mixture in which YAG: Ce based phosphor powder is encapsulated in the silicone resin in an amount of 50 wt % was used. The peak voltage and the peak current of the pulse that activates the light-emitting elements 11*a* and 11*b* were 3.7 V and 2.3 A, respectively. An input power to the light-emitting elements 11*a* and 11*b* was controlled by changing a duty ratio which is a ratio between the pulse width and the pulse period. The cycle of the current pulse, which activates the light-emitting elements 11*a* and 11*b*, was 1 ms. In the light-emitting element 11*a*, which was positioned above the focal point on the central axis by 1.5 mm, the duty ratio was 40%, i.e., the pulse width was 0.4 ms. In the light-emitting element 11*b*, which was positioned horizontally away from the focal point on the central axis by 3 mm, the duty ratio was 60%, i.e., the pulse width was 0.6 ms. Thus, the average input power to the light-emitting element 11*a* was 3.4 W and the average input power to the light-emitting element 11*b* was 5.1 W. The measurement was conducted while the ambient temperature was retained at 85° C.

Figure 14:
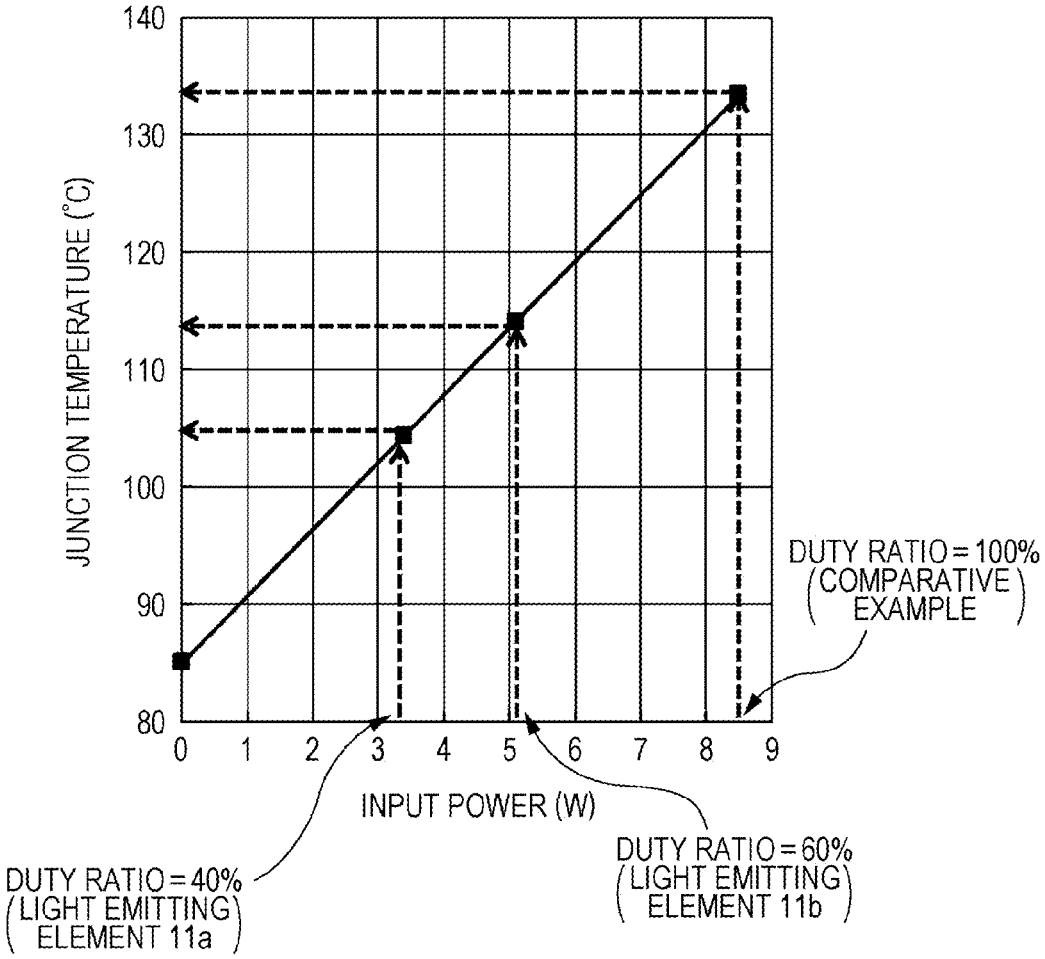
FIG. 14 is a view showing dependence of a junction temperature of semiconductor light-emitting elements on input power in the lamp of the third example of the present disclosure.

FIG. 14 is a graph showing dependence of the junction temperature of the semiconductor light-emitting element on the input power. The junction temperature was measured using a transient thermal resistance method. When the junction temperature of the semiconductor light-emitting element is increased, an emission wavelength generally moves to the long wavelength side, and thus emission efficiency is lowered. The junction temperature is preferably 110° C. or lower. As shown in FIG. 14, in an example (comparative example) including one light-emitting element in which the duty ratio of the pulse was 100%, the input power was 8.5 W and the junction temperature was 133° C. In the lamp of this example including the light-emitting elements 11*a* and 11*b*, the duty ratios thereof were set at 40% and 60%, respectively, and the average input power of each of the light-emitting elements 11*a* and 11*b* was 3.4 W and 5.1 W. As a result, the junction temperature of the light-emitting elements 11*a* and 11*b* was 114° C. and 104° C., respectively. As can be seen from this, in this example, the junction temperature was sufficiently reduced under excessively high ambient temperature of 85° C. The configuration of this example is preferably used as a vehicle lamp.

As apparent from the above-described example, the beam profile can be horizontally elongated without the optical components, which may lead to the optical loss, and the junction temperature of the light-emitting element can be lowered. With this configuration, even when the lamp is used as a searchlight, a vehicle head-up display, or a vehicle headlamp, which may be constantly vibrated, stray light is prevented, and high emission efficiency is maintained. According to this example, the lamp can have higher-quality properties.

The present disclosure should not be limited to the above-described first to fourth embodiments and first to third examples, and various modifications may be applied thereto. Any configuration of the first to fourth embodiments and the first to third examples may be combined or at least one of the components may be eliminated or replaced.

In the above-described embodiments and examples, the reflection surface of the concave mirror of the lamp mainly has a shape formed by rotating a parabola (paraboloid), but not limited thereto. The reflection surface may have a shape formed by rotating a segment of an ellipse or a hyperbola. Alternately, the reflection surface may have a shape formed by rotating a segment of any other non-linear curve. When such a shape is employed, the position or the orientation of each of the wavelength conversion element 10 and the light-emitting elements 11 may be adjusted depending on the shape of the reflection surface.

In the above-described embodiments and the examples, two light-emitting elements are used as the excitation light sources. However, three or more light-emitting elements may be used. In addition, the light-emitting element is not limited to the semiconductor light-emitting element. Any laser other than the semiconductor may be used as the light-emitting element.

In the present disclosure, the control circuit 80 shown in FIG. 12 may include a semiconductor device, a semiconductor integrated circuit (IC) or an LSI. The LSI or IC can be integrated into one chip, or also can be a combination of plural chips. For example, functional blocks other than a memory may be integrated into one chip. The name used here is LSI or IC, but it may also be called system LSI, VLSI (very large scale integration), or ULSI (ultra large scale integration) depending on the degree of integration. A Field Programmable Gate Array (FPGA) that can be programmed after manufacturing an LSI or a reconfigurable logic device that allows reconfiguration of the connection or setup of circuit cells inside the LSI can be used for the same purpose.

Further, it is also possible that all or a part of the functions or operations of the control circuit 80 are implemented by executing software. In such a case, the software is recorded on one or more non-transitory recording media such as a ROM, an optical disk or a hard disk drive, and when the software is executed by a processor, the software causes the processor together with peripheral devices to execute the functions specified in the software. A system or apparatus may include such one or more non-transitory recording media on which the software is recorded and a processor together with necessary hardware devices such as an interface.

The lamp of the present disclosure may be used as a light source of a special lighting, a spotlight, a searchlight, a head-up display, a projector, or a vehicle headlamp.

What is claimed is:

1. A lamp comprising:

a plurality of semiconductor light-emitting elements configured to emit excitation light;

a wavelength conversion element configured to convert the excitation light into light having a peak wavelength different from a peak wavelength of the excitation light; and a concave mirror configured to reflect the excitation light emitted from the plurality of semiconductor light-emitting elements to the wavelength conversion element and reflect the light from the wavelength conversion element toward an outside of the lamp, wherein the plurality of semiconductor light-emitting elements include a first semiconductor light-emitting element and a second semiconductor light-emitting element, a distance y1 from an optical axis of the first semiconductor light-emitting element to an optical axis of the concave mirror and a distance y2 from an optical axis of the second semiconductor light-emitting element to the optical axis of the concave mirror are independently set to satisfy: $(D+Dphos)/2 \leq y1 \leq 4f$, and $4f < y2 \leq R$, in which D is a beam diameter of the excitation light, Dphos is a length of the wavelength conversion element in a direction perpendicular to the optical axis of the concave mirror, within a plane including the optical axis of the concave mirror and at least one selected from the optical axes of the first and second semiconductor light-emitting elements, f is a focal distance of the concave mirror, and R is a radius of an opening of the concave mirror, locations of the first semiconductor light-emitting element and the second semiconductor light-emitting element are asymmetric with respect to the optical axis of the concave mirror, and the lamp produces elliptical shaped light.

2. The lamp according to claim 1, wherein the wavelength conversion element includes a phosphor that emits light having a peak wavelength longer than that of the excitation light when excited by the excitation light.

3. The lamp according to claim 2, wherein the wavelength conversion element has a section including the phosphor positioned in a focal area of the concave mirror.

4. The lamp according to claim 3, wherein a center of a surface of the section including the phosphor is positioned in the focal area of the concave mirror.

5. The lamp according to claim 1, wherein the plurality of semiconductor light-emitting elements are each positioned to emit the excitation light parallel to the optical axis of the concave mirror, and the wavelength conversion element is positioned to avoid blocking the excitation light traveling from the plurality of semiconductor light-emitting elements to the concave mirror.

6. The lamp according to claim 1, wherein the wavelength conversion element is positioned on the optical axis of the concave mirror at a concave side of the concave mirror, and in a projection view in which the plurality of semiconductor light-emitting elements and the wavelength conversion element are projected onto a plane extending perpendicular to the optical axis of the concave mirror, one of the plurality of semiconductor light-emitting elements is located in a first direction with respect to the wavelength conversion element and another one of the plurality of semiconductor light-emitting elements is located in a second direction with respect to the wavelength conversion element, the second direction being perpendicular to the first direction.

7. The lamp according to claim 1, wherein the concave mirror has a reflection surface having a rotational parabolic shape.

8. The lamp according to claim 1, wherein the concave mirror has a reflection surface having a shape formed by rotating a segment of an ellipse.

9. The lamp according to claim 1, wherein the concave mirror has a reflection surface having a shape formed by rotating a segment of a hyperbola.

10. The lamp according to claim 1, wherein the concave mirror has a reflection surface having a shape formed by rotating a segment of a non-linear curve.

11. The lamp according to claim 1, further comprising a control circuit that causes the first semiconductor light-emitting element and the second semiconductor light-emitting element to alternately emit the excitation light.

12. The lamp according to claim 11, wherein the control circuit causes the second semiconductor light-emitting element to emit the excitation light for a longer time than the first semiconductor light-emitting element.

13. A vehicle headlamp comprising a lamp comprising:

a plurality of semiconductor light-emitting elements configured to emit excitation light;

a wavelength conversion element configured to convert the excitation light into light having a peak wavelength different from a peak wavelength of the excitation light; and a concave mirror configured to reflect the excitation light emitted from the plurality of semiconductor light-emitting elements to the wavelength conversion element and reflect the light from the wavelength conversion element toward an outside of the lamp, wherein the plurality of semiconductor light-emitting elements include a first semiconductor light-emitting element and a second semiconductor light-emitting element, a distance y1 from an optical axis of the first semiconductor light-emitting element to an optical axis of the concave mirror and a distance y2 from an optical axis of the second semiconductor light-emitting element to the optical axis of the concave mirror are independently set to satisfy: $(D+Dphos)/2 \leq y1 \leq 4f$, and $4f < y2 \leq R$, in which D is a beam diameter of the excitation light, Dphos is a length of the wavelength conversion element in a direction perpendicular to the optical axis of the concave mirror, within a plane including the optical axis of the concave mirror and at least one selected from the optical axes of the first and second semiconductor light-emitting elements f is a focal distance of the concave mirror, and R is a radius of an opening of the concave mirror, locations of the first semiconductor light-emitting element and the second semiconductor light-emitting element are asymmetric with respect to the optical axis of the concave mirror, and the lamp produces elliptical shaped light.

14. The lamp according to claim 1, wherein the optical axis of the first semiconductor light-emitting element and the optical axis of the second semiconductor light-emitting element are asymmetric with respect to the optical axis of the concave mirror.

15. The lamp according to claim 1, wherein the optical axis of the first semiconductor light-emitting element is defined as a beam path of a light beam emitted from the first semiconductor light-emitting element just before reflected by the concave mirror, and the optical axis of the second semiconductor light-emitting element is defined as a beam path of a light beam emitted from the second semiconductor light-emitting element just before reflected by the concave mirror.

16. The lamp according to claim 1, wherein the first semiconductor light-emitting element, the second semiconductor light-emitting element, the wavelength conversion element and the concave mirror are arranged such that the excitation light is first reflected by the concave mirror and then the reflected light reaches the wavelength conversion element.

* * * * *